US006404342B1

(12) United States Patent
Planer et al.

(10) Patent No.: US 6,404,342 B1
(45) Date of Patent: Jun. 11, 2002

(54) FLAME DETECTOR USING FILTERING OF ULTRAVIOLET RADIATION FLICKER

(75) Inventors: Norman G. Planer, Annandale; Paul E. Sigafus, Medina, both of MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/952,401

(22) Filed: Sep. 14, 2001

(51) Int. Cl.[7] ..... G08B 17/12

(52) U.S. Cl. ..... 340/577; 340/578; 250/372

(58) Field of Search ..... 340/577, 578, 340/579; 250/339.01, 339.05, 372, 559.19, 559.2, 374, 550, 554

(56) References Cited

U.S. PATENT DOCUMENTS

| | | | | | |
|---|---|---|---|---|---|
| 3,665,440 | A | | 5/1972 | McMenamin | 340/578 |
| 3,852,606 | A | | 12/1974 | Kabat | 250/551 |
| 3,947,218 | A | | 3/1976 | Landis | 431/79 |
| 4,280,058 | A | * | 7/1981 | Tar | 250/554 |
| 4,280,184 | A | * | 7/1981 | Weiner et al. | 340/578 |
| 4,464,575 | A | | 8/1984 | Cholin et al. | 250/554 |
| 4,509,041 | A | * | 4/1985 | Keyes et al. | 340/578 |
| 4,533,834 | A | | 8/1985 | McCormack | 250/554 |
| 4,882,573 | A | * | 11/1989 | Leonard et al. | 340/578 |
| 4,904,986 | A | | 2/1990 | Pinckaers | 340/578 |
| 5,073,769 | A | | 12/1991 | Kompelien | 340/578 |
| 5,189,398 | A | * | 2/1993 | Mizutani | 340/578 |
| 5,227,639 | A | | 7/1993 | Sigafus | 250/554 |
| 5,236,328 | A | | 8/1993 | Tate et al. | 431/14 |
| 5,237,512 | A | | 8/1993 | Davidson | 364/487 |
| 5,245,196 | A | | 9/1993 | Cabalfin | 250/554 |
| 5,424,554 | A | | 6/1995 | Marran et al. | 250/554 |
| 5,748,090 | A | | 5/1998 | Borg et al. | 340/578 |
| 6,060,719 | A | * | 5/2000 | Di'Tucci et al. | 250/554 |
| 6,084,518 | A | * | 7/2000 | Jamieson | 340/577 |
| 6,168,419 | B1 | * | 1/2001 | Mindermann | 431/79 |

* cited by examiner

*Primary Examiner*—Daniel J. Wu
*Assistant Examiner*—Toan Pham

(57) ABSTRACT

A flame detector for a burner system having a flame during combustion that emits UV radiation, has a low gain UV sensor, a capacitor, a band pass filter receiving the capacitor's signal, and a rectifier receiving the band pass filter signal and providing a rectifier signal. A low pass filter receives the rectifier signal and provides a flame signal as an output whose magnitude is indicative of presence or absence of flame. An optical filter interposed between the UV sensor and the flame and having optical bandpass characteristics attenuating UV radiation outside the wavelength associated with the flame, improves operation.

14 Claims, 1 Drawing Sheet

FLAME DETECTOR USING FILTERING OF ULTRAVIOLET RADIATION FLICKER

BACKGROUND OF THE INVENTION

Fuel burners such as those found in water heaters, furnaces, boilers, etc. must have some sort of flame detector for safe operation. The danger resulting from fuel flowing into a combustion space without presence of a flame to burn the fuel is well known. These flame detectors have taken a variety of forms. For small burners such as water heaters and small furnaces, a thermocouple is perfectly adequate to detect the flame.

For larger burners though, the residual heat after flame is accidentally lost is sometimes sufficient to allow a thermocouple to continue to indicate flame. Accordingly, other mechanisms must be used to detect flame in these types of burners. A typical type of detector is the flame rod, which uses the difference in sizes of the metal burner itself and a small anode to function as a rectifier when AC power is applied across them.

Another type of flame detector relies on directly on the radiation provided by the flame. However, the mere presence of visible or IR radiation does not necessarily indicate an active flame. Walls of combustion chambers tend to radiate visible and IR energy for a period of time after flame is lost. It was found, however, that active flames have characteristic flicker frequencies in the IR, visible, and UV wavelengths. Typically, an active flame flickers in the 5 to 15 hz. range (as well as in higher frequencies) in all of these wavelength bands. Heated refractory walls or glowing particles have different flicker frequencies or none at all. So flicker in these wavelengths can be used to reliably indicate flame. One type of burner system flame detector using the flicker of the flame is described in U.S. Pat. No. 5,073,769.

We find that UV wavelengths are preferable for sensing of active flames for a number of reasons. Efficient combustion of hydrocarbon fuels produce flames that reliably emit UV radiation. When UV is detected, flame is always present, that is there are no false positives from combustion chamber walls or other sources. Presently, discharge tubes are used to detect UV radiation, but these require a high voltage power supply, and the tubes themselves have a relatively short operating life.

Solid-state UV detectors on the other hand are long lasting and operate on low voltage, but have a number of other undesirable characteristics. High gain or sensitive solid-state UV detectors lack temperature stability and do not have consistent electrical characteristics from one unit to the next. Low gain solid-state UV detectors are stable and have more consistent characteristics, but these provide very low signal output, typically in the tenths of a lamp. UV detectors that don't have these disadvantages tend to be too expensive for flame detector applications. Accordingly, suitable solid-state flame detectors based on sensing UV radiation have not been available.

BRIEF DESCRIPTION OF THE INVENTION

We have devised a circuit that can process the output of a low gain or low output UV sensor by using the UV radiation flicker in the sensor output, to thereby reliably detect when flame is present. The low gain UV sensor is of the type providing a raw UV signal varying with the level of UV energy impinging on the UV sensor. In a preferred embodiment, the UV sensor comprises a photodiode providing a sensing element signal comprising a varying low level current and includes a transimpedance amplifier receiving the sensing element signal and providing the raw UV signal as a varying voltage signal.

A capacitor receives the raw UV signal from the UV sensor and provides an AC UV signal following the changes in the raw UV signal but excluding at least a part of any DC component in the raw UV signal. A band pass amplifier receives the AC UV signal and provides a band pass amplifier signal encoding the frequencies within a preselected frequency range present in the AC UV signal. The band pass amplifier has a preferred frequency range of 5 to 15 Hz. We prefer a multistage band pass amplifier to provide better frequency rolloff at the boundaries of the preferred frequency range. A rectifier receives the band pass amplifier signal and provides a rectifier signal. Preferably, the rectifier is a full wave rectifier.

A final stage low pass filter receives the rectifier signal and provides a flame signal encoding the frequencies below a preselected frequency present in the rectifier signal. The level of the flame signal indicates the presence or absence of a flame. We prefer a low pass filter that blocks most frequencies above approximately 3–5 Hz.

DESCRIPTION OF THE PREFERRED EMBODIMENT

Figure 1:
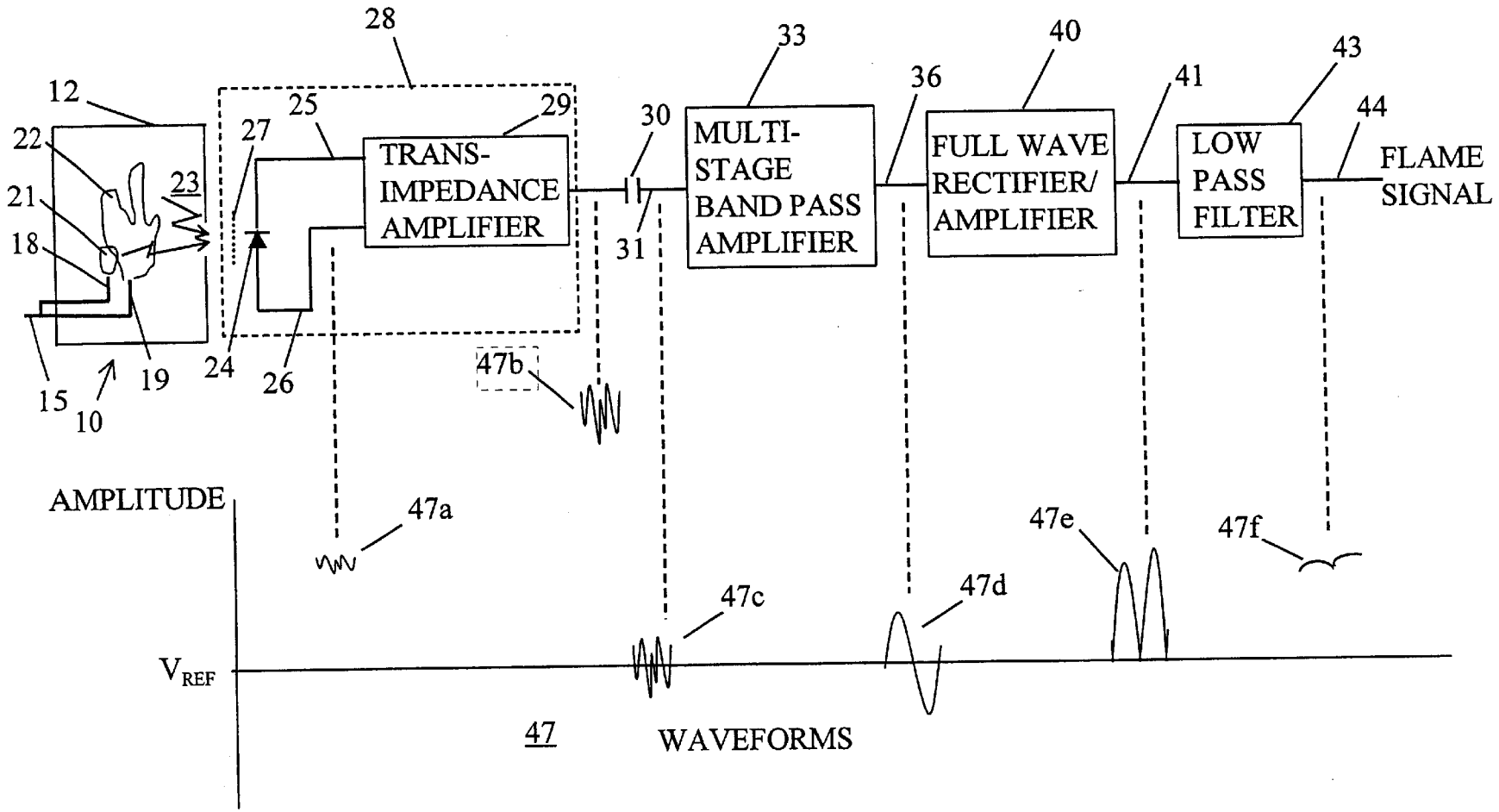
FIG. 1 is a block diagram of the invention with representative waveforms for each block's output.

FIG. 1 shows the structure of a burner system 10 having fuel for combustion provided through a pipe 15. A combustion chamber 12 has within itself a pilot burner 18 supporting a flame 21 and a main burner 19 supporting a main flame 22. These flames 21 and 22 emit visible light and infrared (IR) and UV radiation shown as zigzag arrows at 23. Valves and controls for controlling flow of fuel to both burners 18 and 19 are not shown and form no part of this invention.

It is important to assure that so long as fuel is flowing to burners 18 and 19, that the associated flames 21 and 22 are present. If this is not true, fuel can accumulate in combustion chamber 12 or if the fuel is gaseous, escape into the surrounding space, in either case creating a hazard. Experience teaches that flames 21 and 22 can disappear even though fuel may continue to flow thereafter unless valves controlling fuel flow are closed.

Accordingly, all types of burners must have some sort of flame detecting system. The system shown here has a solid-state UV-sensitive photodiode 24 (shown much larger than actual size relative to combustion chamber 12) as the sensing element, and mounted so that UV radiation at 23 emitted by flames 21 and 22 can pass through an aperture in combustion chamber 12 and impinge on photodiode 24. Photodiode 24 provides a sensing element signal whose current level indicates the intensity of impinging UV radiation. We find that UV radiation in the range of 310 nm. is particularly suitable for detection of natural gas flames. Many if not most combustion systems for which this invention is applicable use natural gas as fuel.

As an example of a suitable sensing element, we prefer to use as photodiode 24 a silicon carbide photodiode element available as Part. No. CD260-0.30D from Cree Research, Durham, N.C. In other embodiments, photodiode 24 can be replaced with a DC voltage source and UV-sensitive photoconductor providing a voltage varying as the level of UV radiation changes. At this point, UV-sensitive photoconductors with consistent electrical characteristics are not available, so photodiodes are preferred. However, photodiode 24 has output measured only in picoamps. when UV radiation of the intensity provided by a small pilot flame such as flame 21 located at least several tenths of a meter away is impinging on photodiode 24, so other types of sensing elements may well be preferred in the future. At any rate, the small signal levels require careful processing of the photodiode signal.

While good results are possible by relying only on the inherent spectral selectivity of a properly selected photodiode 24 such as the aforementioned Cree device, the system spectral response can be further improved by inserting an optical filter 27 in the optical path between the flames 21 and 22 and photodiode 24. In general, such a filter 27 should comprise material attenuating radiation outside a wavelength band approximately centered on 310 nm. One suitable wavelength band is from 300 to 325 nm. Another way to say this is that a suitable filter 27 reduces the transmission of long wavelength UV radiation in the 325 nm. (approximately) to 400 nm. range, since little energy is present in wavelengths much shorter than say, 300 nm.

One suitable device is an optical band pass filter manufactured by Hoya as Part. No. U-340, and available from Edmund Industrial Optics, Barrington, N.J. 08007 with Cat. No. K46-096. The U-340 device attenuates a significant amount of wavelengths longer than 340 nm. We also find that a solar blind filter available as Part No. 57810 from Oriel Instruments, 150 Long Beach Blvd., Stratford Conn., 06615, provides useful attenuation of radiation outside the 250 nm. to 330 nm. band. Oriel Instruments also supplies a 310 nm. interference filter, Part No. 53375, that blocks substantial amounts of radiation outside of a narrow wavelength band centered on the 310 nm. emission peak of a natural gas flame.

The addition of an optical filter 27 reduces the total radiation incident on the sensor, and, consequently, the total electrical signal is also reduced. However, the signal-to-noise ratio (signal referring that produced by radiation near the 310 nm. wavelength) is substantially increased by use of a suitable filter 27. Additional optical or electrical gain may be required to compensate for the loss of total signal but there are a number of simple steps that can be taken to compensate for this loss. For example, photodiode 24 can be moved closer to flames 21 and 22, a lens can be used to focus more of the radiation on photodiode 24, or gain can be added to one or more of the downstream amplifier stages that will shortly be discussed. Filter 27 provides some protection for photodiode 24 against excessive radiation far outside the band centered at 316 nm.

For convenience in explaining the invention, FIG. 1 shows a set of waveforms 47, each of the waveforms associated by a dotted line with the signal carried on the indicated conductor. The waveforms are not to scale as to either time on the abscissa or magnitude on the ordinate, but are merely intended to illustrate the general waveform shape at the indicated conductor. The waveforms are shown relative to a reference voltage $V_{REF}$. $V_{REF}$ need not be at or near ground or 0 v., nor need $V_{REF}$ be symmetrically positioned between the maximum and minimum voltage level outputs of the various amplifiers comprising the component blocks in the diagram. Because of the high voltage amplifications provided by the system components, we find that distortion caused by asymmetrical clipping of positive and negative peaks during the amplification has little effect on the final output of the system on path 44. In point of fact, we have designed two commercial versions of this system. Both use voltage referenced between +5 v. and ground (0 v.) to operate the amplifiers. One of these versions uses a $V_{REF}$ of approximately 1 v., the other a $V_{REF}$ of 2.5 v., i.e. midway in the operating voltage range. Each design operates successfully to detect UV radiation modulations in the 5–15 Hz. range.

The sensing element signal provided by this type of photodiode 24 is a current signal, shown representatively in waveform 47*a*. The peak-to-peak UV signal component current variations are as previously stated, typically measured in a few picoamps. when flame 21 or 22 is present. The sensing element signal has a substantial DC component as well that may be an order of magnitude larger than the signal component.

Conductors 25 and 26 provide the sensing element signal to a transimpedance amplifier 29. Amplifier 29 and photodiode 24 together comprise a UV sensor 28. Transimpedance amplifier 29 converts the sensing element signal, whose information content is present in the current variations, to a voltage-based raw UV signal. The peak-to-peak value of the raw UV signal can be measured in perhaps tenths of a mv., with a DC component again perhaps an order of magnitude larger. Short segments of the raw UV signal patterns are similar to that of waveform 47*b*.

The raw UV voltage signal output of amplifier 29 is provided to a capacitor 30 that blocks the DC component, so the raw UV signal is converted to an AC UV signal waveform at conductor 31 having very little DC component. (Recall these measurements and level shifts are with respect to $V_{REF}$ and may well be substantially displaced from earth ground or system common.) A representative example of the AC UV signal is shown as waveform 47*c*. Capacitor 30 may have a value of around 0.47 $\mu$fd. Theoretically, other types of components may be used to reduce or eliminate the DC component in the raw UV signal, and these other components are to be included in the general term "capacitor" even if they are not true capacitors.

The AC UV signal at conductor 31 is provided to the input of a multi-stage band pass amplifier 33. Where the AC UV signal swings both above and below the 0 v. point, it is necessary for amplifier 33 to be powered by a supply providing both positive and negative voltages. In a preferred embodiment, band pass amplifier 33 has five low pass filter stages and two high pass filter stages that eliminate most of the amplitude modulations in the AC UV signal outside of a frequency band of about 5 to 15 hz. Band pass amplifier 33 also includes two amplifying stages that amplify the voltage of the AC UV signal by a factor of at least thousands, resulting in a band pass amplifier signal output whose magnitude when flame is present is on the order of a tenth of a volt.

The UV waveform of an active flame has a characteristic flicker or amplitude modulation in the 5 to 15 hz range, and amplifier 33 preferably provides a band pass amplifier signal to conductor 36 having frequencies only in this range. The band pass characteristics of amplifier 33 are needed to eliminate various frequencies that are present when flame is not present. These frequencies arise from sources such as noise inevitable in high gain amplifier circuits and sensitive detectors such as photodiode 24. The structure of band pass amplifiers such as amplifier 33 is well known to those familiar with analog signal processing circuits. The commercial embodiment here has two operational amplifiers cooperating with the five low pass and two high pass filters to provide the filtering and amplifying functions. The associated waveform 47*d* is representative of the band pass amplifier signal provided by amplifier 33 in this application.

The band pass amplifier signal on conductor 36 is provided to an input of a full wave rectifier/amplifier 40 where the voltage amplitude is further multiplied by a factor of around 10 or more. The signal is also full wave rectified by rectifier/amplifier 37, resulting in the rectified UV signal carried on path 41 and shown at 47*e* as an all-positive voltage. It is equally possible to provide an all-negative rectified UV signal. The average output voltage may be in the range of 1–4 v. when flames 21 or 22 are present. Rectifier/amplifier 37 may comprise a pair of any of a number of well-known operational amplifiers. A common full wave diode bridge rectifies the amplifiers' output. The rectification doubles the frequency of the signal as shown in waveform 47*e*, so the range of interest becomes 10–30 hz. Full wave rectification makes both positive and negative halves of the amplifier signal available in the rectified signal on conductor 41, increasing overall sensitivity of the system.

The rectified UV signal is applied to the input of a low pass filter 43, which may also be considered to be a ripple filter, and whose output is the flame signal indicative of flame 21 or 22. A representative waveform for the flame signal on path 44 is shown at 47*f*, and can be seen to be a slowly varying positive DC voltage. The flame signal is approximately proportional to the average recent area between the abscissa and the rectified UV signal. Low pass filter 43 should significantly attenuate frequencies above the 3–5 hz. range.

The magnitude of the flame signal on path 44 is quite small when flames 21 and 22 are not present. When either flame 21 or 22 is present, the voltage magnitude on path 44 is typically 0.5 v. or more positive than $V_{REF}$. When neither flame 21 nor 22 is present, the voltage magnitude on path 44 is typically no more than 0.1 v. positive with respect to $V_{REF}$. Further, the transition between then two voltage levels once both flames 21 and 22 vanish is typically on the order of tenths of a second.

A burner control system can perform a simple magnitude comparison of the level of the flame signal on path 44, and if the difference between the flame signal and $V_{REF}$ is greater than 0.5 v., presence of flame 21 or 22 is virtually certain. When selecting the voltage difference, of course avoiding false positive indications of flame is much more important than avoiding false negatives.

The preceding has described our invention. We wish to protect that invention with a patent containing the following claim:

1. A flame detector comprising:

a) a UV sensor providing a raw UV signal whose level varies with the level of UV energy impinging on the UV sensor;

b) a capacitor receiving the raw UV signal and providing an AC UV signal having the AC component of the raw UV signal less at least a part of any DC component therein;

c) a band pass amplifier receiving the AC UV signal and providing a band pass amplifier signal having the frequencies within a preselected frequency range present in the AC UV signal;

d) a rectifier receiving the band pass filter signal and providing a rectified UV signal; and e) a low pass filter receiving the rectified UV signal and providing a flame signal encoding the frequencies below a preselected frequency present in the rectified UV signal.

2. The detector of claim 1, wherein the band pass amplifier further includes a plurality of amplifying stages, a plurality of low pass filter stages, and a plurality of high pass filter stages.

3. The detector of claim 2 wherein the low pass and high pass filter stages eliminate most of the amplitude modulations outside of the frequency range of approximately 5 to 15 hz.

4. The detector of claim 3 wherein the rectifier is a full wave rectifier/amplifier.

5. The detector of claim 4 wherein the UV sensor includes a) a photodiode providing a sensing element signal whose current level indicates the intensity of impinging UV radiation; and b) a transimpedance amplifier converting the current level in the sensing element signal to the raw UV signal whose voltage level indicates the intensity of UV radiation impinging on the photodiode.

6. The detector of claim 4, wherein the low pass filter is of the type significantly attenuating frequencies above the 3–5 Hz. range.

7. The detector of claim 1, wherein the UV sensor further comprises a sensing element providing a sensing element signal having a low level current varying with the level of impinging UV radiation, and a transimpedance amplifier receiving the sensing element signal and providing the raw UV signal as a varying voltage signal.

8. The detector of claim 1, wherein the low pass filter is of the type significantly attenuating frequencies above the 3–5 Hz. range.

9. The detector of claim 1, wherein the UV sensor comprises a UV photodiode.

10. The detector of claim 9, wherein the UV photodiode comprises a silicon carbide UV photodiode.

11. The detector of claim 10, wherein the UV sensor further comprises a) a sensing element for detecting a flame emitting UV radiation along a preselected path, said sensing element in said preselected path; and b) an optical filter interposed in the preselected path between the flame and the sensing element.

12. The detector of claim 11, wherein the optical filter comprises material attenuating radiation outside a wavelength band approximately centered on 310 nm.

13. The detector of claim 1, wherein the UV sensor further comprises a) a photodiode for detecting a flame emitting UV radiation along a preselected path, said photodiode in said preselected path; and b) an optical filter interposed in the preselected path between the flame and the photodiode.

14. The detector of claim 13, wherein the optical filter comprises material attenuating radiation outside a wavelength band approximately centered on 310 nm.

* * * * *